US005575341A

United States Patent [19]

Baker et al.

[11] Patent Number: 5,575,341

[45] Date of Patent: Nov. 19, 1996

[54] MECHANICAL FOAM FIRE FIGHTING EQUIPMENT AND METHOD

[75] Inventors: Kenneth C. Baker, Mauriceville; Dwight Williams; Leslie P. Williams, both of Vidor, all of Tex.

[73] Assignee: CCA, Inc., Vidor, Tex.

[21] Appl. No.: 274,651

[22] Filed: Jul. 11, 1994

Related U.S. Application Data

[63] Continuation of Ser. No. 7,591, Jan. 22, 1993, abandoned.

[51] Int. Cl.[6] ..... A62C 31/12

[52] U.S. Cl. ..... 169/70; 169/14; 169/15; 239/422; 239/424

[58] Field of Search ..... 169/70, 14, 15; 239/424, 422, 524

[56] References Cited

U.S. PATENT DOCUMENTS

| | | | |
|---|---|---|---|
| 2,198,585 | 4/1940 | Urquhart et al. | 169/15 X |
| 2,586,348 | 2/1952 | Kuebler | 239/524 |
| 2,961,050 | 11/1960 | MacCracken et al. . | |
| 3,020,819 | 2/1962 | Kunen | 239/524 |
| 3,029,030 | 4/1962 | Dey | 239/524 |
| 3,356,148 | 12/1967 | Jamison | 169/15 |
| 3,438,445 | 4/1969 | MacCracken et al. . | |
| 3,918,647 | 11/1975 | Lamz et al. | 169/14 X |
| 4,497,442 | 2/1985 | Williams . | |
| 4,614,237 | 9/1986 | Colodner et al. | 169/12 |
| 4,640,461 | 2/1987 | Williams | 169/15 |
| 4,662,454 | 5/1987 | Uchiyama et al. | 169/15 |
| 4,828,038 | 5/1989 | Williams . | |
| 4,896,384 | 1/1990 | Dijkhuizen | 239/524 |
| 5,113,945 | 5/1992 | Cable . | |
| 5,167,285 | 12/1992 | Williams . | |
| 5,312,041 | 5/1994 | Williams et al. | 169/14 |

FOREIGN PATENT DOCUMENTS

| | | | |
|---|---|---|---|
| 480541 | 2/1977 | Australia . | |
| 1114517 | 4/1956 | France | 239/524 |
| 2608438 | 12/1977 | France . | |
| 1759749 | 7/1971 | Germany . | |
| 3620574 | 12/1987 | Germany . | |
| 4012852 | 10/1991 | Germany . | |
| 1160056 | 6/1985 | U.S.S.R. | 169/14 |
| 1430548 | 10/1988 | U.S.S.R. | 169/12 |
| 1509087 | 9/1989 | U.S.S.R. | 169/14 |
| 2203065 | 10/1988 | United Kingdom | 239/424 |

OTHER PUBLICATIONS

The Motor Ship, vol. 52, Jul. 1971, p. 160 "A dual role for the Kongsberg gas turbine—prime mover and inert gas generator".

*Primary Examiner*—Gary C. Hoge

*Attorney, Agent, or Firm*—Sue Z. Shaper; Butler & Binion, L.L.P.

[57] ABSTRACT

Mechanical foam fire fighting equipment and method wherein an inert gas is delivered to a foaming chamber of a mechanical foam making assembly, the foaming chamber also receiving a liquid and foam concentrate, the inert gas in some embodiments being supplied by the exhaust of an engine.

8 Claims, 5 Drawing Sheets

FIG. 3
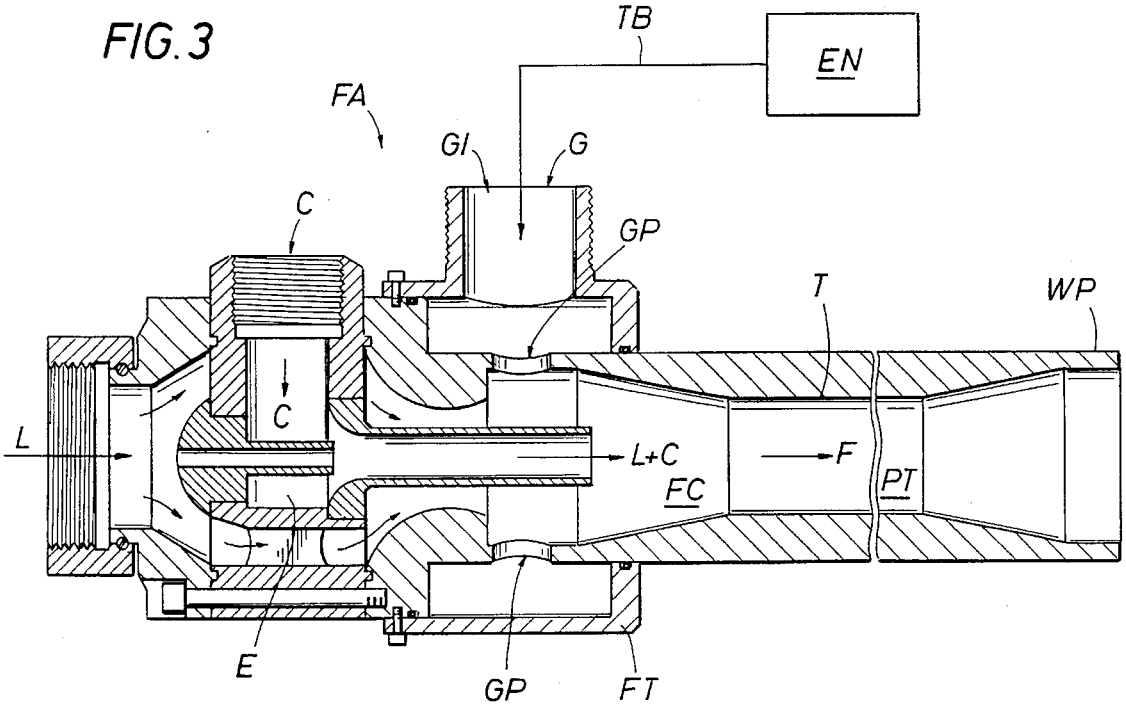
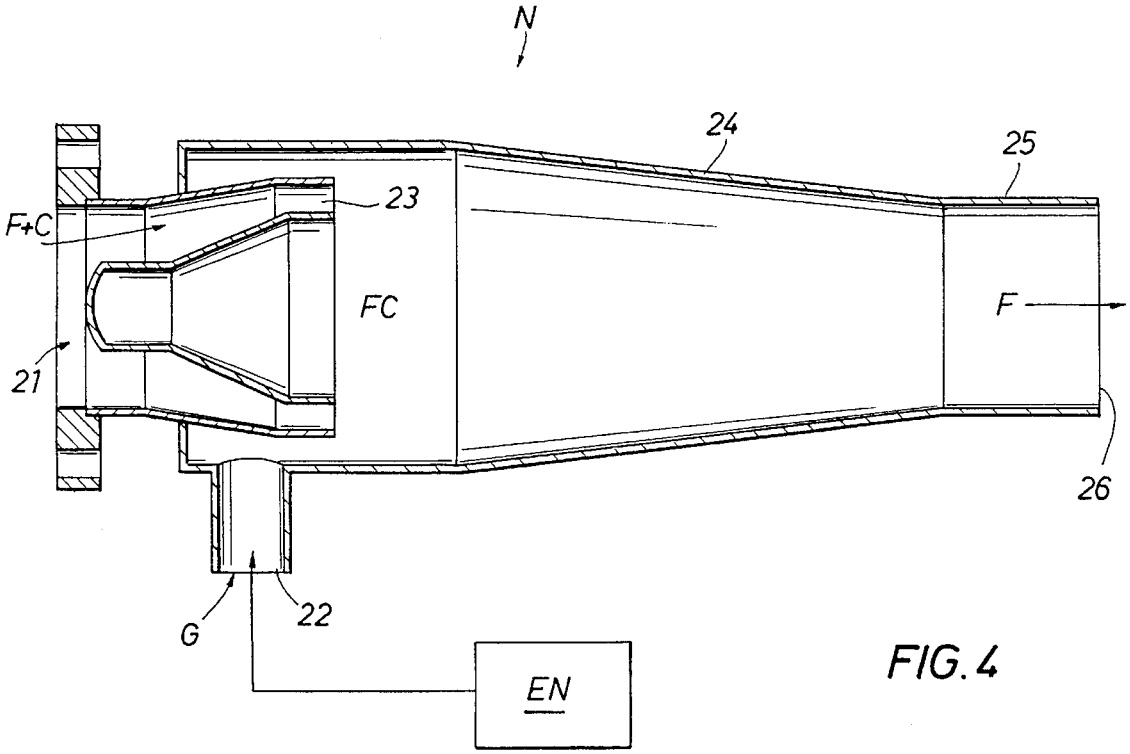
FIG. 4

SUPPLY OF GAS
56
53
FA
N
SS
S
F
FC
58
57
L
51
G
59
FC
L
55
FC
F
SS
S
52
L+C

SUPPLY OF GAS
69
G
62
61
L+C
66
69
FA
68
64
70
N
68
8C
8C
F
FC
L +C
L +C
FC
F
71
71
68
FC
68
64
63

MECHANICAL FOAM FIRE FIGHTING EQUIPMENT AND METHOD

This application is a continuation application of Ser. No. 08/007,591, filed Jan. 22, 1993, now abandoned.

Field of Invention

This invention relates to the field of mechanical foam fire fighting equipment and methods.

BACKGROUND OF THE INVENTION

Equipment and methods that create and utilize mechanical foam to extinguish fires are known. In particular, fire fighting equipment and methods that utilize foam generated mechanically in a foaming chamber are taught in U.S. Pat. Nos. 4,828,038, 4,497,442 and 5,167,285, which are assigned to the same assignee as the present invention.

In mechanical foam fire fighting equipment, a liquid, such as water, and a foam concentrate, such as the "AFFF" product of Minnesota Mining and Manufacturing Co., are typically supplied to a foam making assembly. The foam making assembly contains a foaming chamber for receiving the liquid and the foam concentrate, either separately or together.

Typically, the liquid is delivered under pressure. The foam concentrate may also be delivered under pressure. The foam concentrate may be educted into the assembly through eductor means supported and disposed within the foam making assembly, as known in the art, or the concentrate might be pumped or gravity fed to the assembly. The foam concentrate and liquid may be mixed, partially or totally, prior to supply to the assembly.

Air and/or ambient vapors in the atmosphere are inducted into the foam chamber according to the teachings of present art mechanical foam equipment. What is referred to as "mechanical foam" in the trade is sometimes also referred to as "air foam". Usually the air or ambient atmospheric vapors are inducted into the foaming chamber subsequent to, or at least simultaneously with, the supply of the mixture of the liquid and foam concentrate to the chamber. The air may also be supplied under pressure.

The foam making assembly may comprise a fire fighting nozzle that throws the foam generated to the fire. Alternately, the foam may be delivered from the assembly to the fire through discharge tubing or piping.

A mechanical foam making assembly includes a foaming chamber area appropriate for the mechanical formation of suitable bubbles from the concentrate, the liquid and the air. The mixing takes place as a result of the turbulence created in the chamber with the moving fluids. The turbulence in the chamber area aerates the liquid and concentrate into foam. The foam is then discharged from an outlet end of the mixing chamber area.

It should be understood that the primary bubbles of the foam are formed in the foaming chamber area. Depending upon the equipment this area is more or less defined by the physical structural walls of the assembly.

A subtle problem has been discovered associated with present art mechanical foam equipment. The problem has been encountered, in fact, utilizing equipment substantially as described in U.S. Pat. No. 4,828,038, and in particular as illustrated in FIG. 5 of that patent.

In the combustion of a large tank of flammable liquid, to discuss a key example, it is common for mechanical foam to be supplied to the tank by piping the foam to an inlet at a low level. The level is above any anticipated water level but below substantially all of the flammable fluid. According to the design of the equipment and technique, the foam, so injected, rises through the liquid contents of the tank to the surface. Upon reaching the surface, the foam isolates the burning contents from its necessary oxygen source, thereby choking off the fire.

This isolation and choking effect does not last for an unlimited period of time. The "25% drain time" of a particular foam is defined as the amount of time required for 25% of the bubbles comprising the foam to burst and form water. After the "25% drain time" period, it is recognized that a significant amount of the blanketing capacity of the foam is lost. Because of this loss, techniques are taught to attempt to extend the "25% drain time" of various foams in a variety of fire fighting situations. Nonetheless, the "drain time" remains a factor requiring the constant supply of new foam to the fire.

It is now appreciated that there is a potentially significant further effect from the bursting of the foam bubbles on the fire, in addition to the loss of the foam blanket and the formation of water. This effect arises from the freeing of the air or atmospheric vapors that are entrained in the formed bubbles.

During a recent extinguishment of a fire in a large flammable liquid storage tank having a floating roof, it is believed that a countervailing effect was experienced from the oxygen released from the entrained air. The oxygen released from the air or atmosphere in the bubbles under the floating roof appeared to feed the fire. The supply of oxygen raised the possibility that the enclosed space under the roof might reach an explosive range.

The present invention solves the above problem. The present invention discloses an "inert mechanical foam", useful not only in applications such as the above referenced flammable liquid tank fire, but also in many other situations. One such application might involve the use in an enclosed or semi-enclosed space such as a fuselage of a burning airplane or a room or compartment within a burning building or ship. An inert foam would even have some usefulness on fires exposed to the atmosphere.

"Inert mechanical foam" is used herein to mean a mechanical foam whose bubbles are created through the agitation of a foam concentrate, a liquid and an inert gas. An inert gas is supplied in lieu of, or at least predominantly in lieu of, utilizing the standard air or prevalent ambient atmospheric vapors as taught by the prior art. "Inert gas" refers to an inert material that is generally gaseous at ambient temperature and pressure. This inert gas, of course, could be liquified for delivering, supply and/or storage purposes.

An inert mechanical foam, when its bubbles burst, would not serve to feed a fire additional oxygen but would rather provide an additional choking effect.

A further aspect of the present invention is that the means for generating an inert gas for use in producing an inert mechanical foam is commonly at hand at most fire scenes. Most fire fighting equipment utilize an engine, such as a diesel or a propane engine, as a means for pumping or at least for transportation purposes. Engines can be regarded, in effect, as inert gas generators. A primary product of most combustion engines is the inert gas $CO_2$. Calculations indicate that the size of most engines associated with fire fighting equipment is sufficient to generate the inert gas needed to aerate the mechanical foam produced by the equipment. The amount of undesirable by-products of the combustion of the engine is relatively low, considering the circumstances, and even those can be filtered. The engine itself can further be used to power a blower to propel or pressure the exhaust gas to the assembly. The exhaust gas could be cooled, as with water, if such appeared necessary.

Commercially available inert gas generators are also usually found onboard ship. It is known to use gas from such generators or shipboard flue gas to perform certain tank cleaning functions on board. Such inert gas generators or sources of shipboard flue gas could also be used as the supply of inert gas for producing the inert mechanical foam of the present invention.

The above invention relates to equipment for producing, and methods of use for, what is commonly called in the trade "mechanical foam". This is a foam created by mechanical agitation. It comprises the primary, if not sole, fire fighting foam used today. "Mechanical foam" is sometimes also referred to as "air foam".

A different form of foam has been known historically in the field. This foam is called "chemical foam" and is created by a chemical reaction, generally between an acid and a base. Chemical foams have been known in both dry and aqueous forms. Both forms use the same chemicals: part A (acidic) aluminum sulfate and part B (basic) sodium bicarbonate.

Proteinaceous foam stabilizers are typically added to form the bubbles.

"Chemical foam" happens to produce an inert foam. This foam, however, has not been used for many years in the fire fighting industry for a variety of reasons. The utilization is and has been limited by the difficulties involved in the storage of sufficient chemicals, in the production of foam in sufficient quantities and in the transportation and delivery of the chemical foam to the fire. Chemical foam does not play a significant role in present fire fighting techniques, if indeed it is used at all.

SUMMARY OF THE INVENTION

The present invention discloses mechanical foam fire fighting equipment that includes a foam making assembly having a foaming chamber for receiving a liquid, a foam concentrate and an inert gas. The invention includes a source of supply of inert gas and a means for communicating the inert gas to the foaming chamber.

In one embodiment of the invention the foam making assembly is incorporated into a fire fighting nozzle. In such a nozzle the generated inert mechanical foam is thrown to the fire. In another embodiment of the invention the inert mechanical foam is discharged into a discharge tube to be delivered to the fire. In such embodiment the discharge tube may include a throat of restricted diameter. This throat functions as a passage to provide back pressure to the chamber and to increase the velocity of the foam as it passes through the tube.

One embodiment of the invention teaches utilizing the exhaust of an engine as the source of supply for the inert gas. Engine exhaust can be communicated to the foam making assembly by means of any suitable tubing. The gas, in addition, can be propelled or pressured by a blower powered by the engine. Other embodiments of the invention may utilize a commercially available inert gas generator or shipboard flue gas as the source of supply of inert gas.

The invention also comprises a method for extinguishing fires that includes supplying a liquid, a foam concentrate and an inert gas to a foaming chamber of a mechanical foam making assembly and discharging inert foam from the chamber. The method may include increasing the velocity of the discharged inert foam in a portion of a discharge tube connected to the foaming chamber. The method may also include supplying the inert gas to the foam making assembly by communicating the chamber with the exhaust of an engine. A blower may be driven by the engine to propel or pressure the exhaust.

$CO_2$ or specialized fire extinguishing gases comprise preferred inert gasses. The gas may be stored, supplied and communicated to the chamber in liquid form.

BRIEF DESCRIPTION OF THE DRAWINGS

A better understanding of the present invention can be obtained when the following detailed description of the preferred embodiment is considered in conjunction with the following drawings, in which:

FIG. 3 illustrates in schematic cross-section an embodiment of a foam forming assembly that discharges through a discharge tube.

FIG. 4 illustrates in schematic cross-section an aspirating nozzle with annular orifice adapted with an inert gas inlet.

DESCRIPTION OF THE PREFERRED EMBODIMENTS

Figure 1:
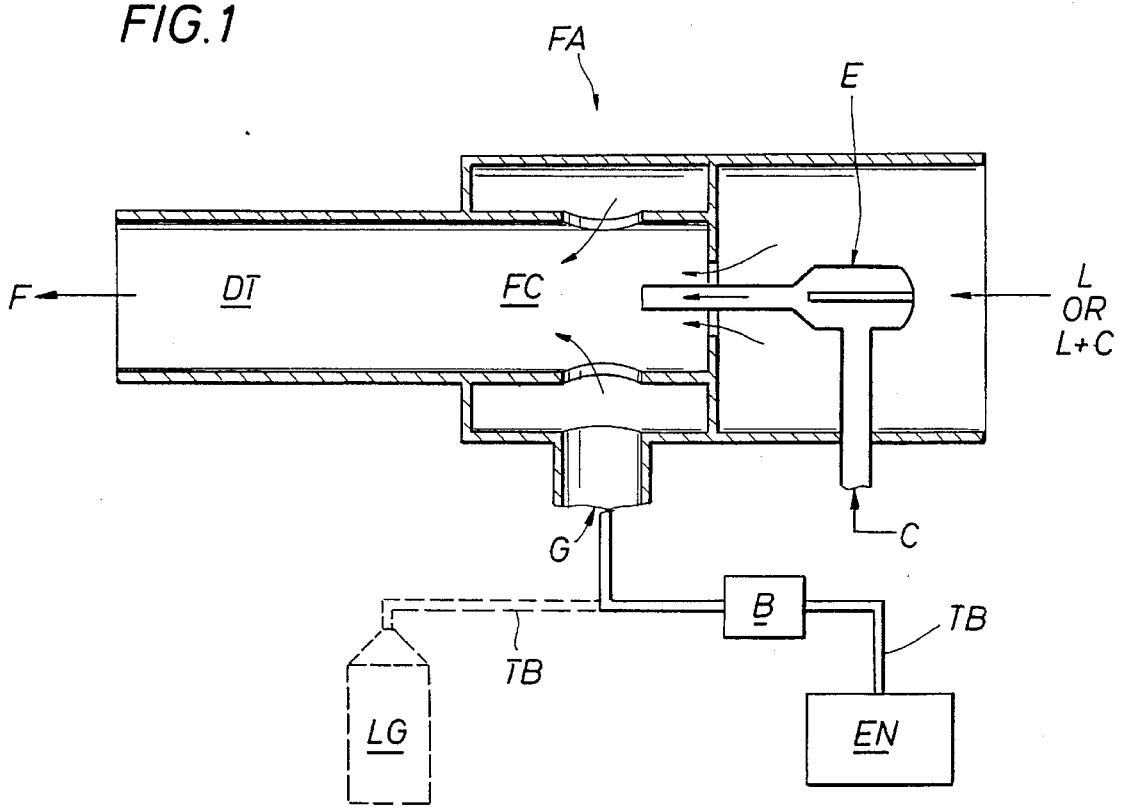
FIG. 1 illustrates schematically a mechanical foam forming assembly of the present invention.

FIG. 1 illustrates schematically the elements of the present invention. FIG. 1 discloses a mechanical foam making assembly FA. The foam making assembly defines within it a foaming chamber area FC.

Alternate means for the supply of liquid L and foam concentrate C to assembly FA and foaming chamber area FC are disclosed in FIG. 1. An eductor E may be employed wherein, according to methods known in the art, a portion of liquid L entering eductor E serves to educt foam concentrate C through eductor E and into foaming chamber area FC. Alternately, liquid L and foam concentrate C may be supplied together to foam making apparatus FA and into foaming chamber area FC.

Foaming chamber area FC also is adapted to contain an inlet for the receipt of inert gas G. Inert gas G may be supplied to assembly FA by any one of a number of means known in the art. For instance, inert gas G may be supplied from a liquid gas bottle LG through tubing TB. Such is indicated by dashed lines in the drawing of FIG. 1. Appropriate valving is known by those in the art.

Inert gas G might also be supplied from the exhaust of engine EN, indicated by a block in the drawing of FIG. 1. Alternately, inert gas might be supplied by a commercially available inert gas generator or by appropriate communication with shipboard flue gas.

For example, a 46 CID diesel engine at 3,000 rpm should have enough exhaust gas for 500 gpm nozzle at a 4 to 1 expansion ratio. Initial calculations indicate that a Lister LPA2 engine should provide sufficient exhaust for a 260 gpm nozzle. A Lister LPA3 engine should provide sufficient exhaust for a 400 gpm nozzle. An LPA2 engine has a 44.3 CID and an LPA3 engine has a 66.5 CID. An LPA2 engine at 2,000 rpm, 2,500 rpm, 3,000 rpm and 3,600 rpm should produce exhaust gas flows of approximately 60 cubic feet per minute, 75 cubic feet per minute, 90 cubic feet per minute and 106 cubic feet per minute, respectively. An LPA3 engine at 2,000 rpm, 2,500 rpm, 3,000 rpm and 3,600 rpm should produce exhaust gas flows of approximately 90 cubic feet per minute, 119 cubic feet per minute, 135 cubic feet per minute and 159 cubic feet per minute, respectively. Preliminary calculations indicate that the total weight of emissions of NO, HC and CO from such engines should be less than one or two ounces per hour.

The exhaust from engine EN may be further propelled or pressured into foaming chamber FC by the use of blower B established in the communicating tubing line TB between engine EN and foam making assembly FA. Given a source of supply of inert gas, in either liquid or gaseous form, one of skill in the art would know a variety of ways by which to arrange to communicate the gas to an inlet fitting on assembly FA.

Specialized fire extinguishing gases may be utilized to provide an inert mechanical foam. Such specialized fire extinguishing gases comprise halon material Halon 1301 ($CF_3Br$), Halon 1211 ($CF_2BrCl$) and Halon 2402 ($C_2F_4Br_2$); perfluorinated materials $CF_4$, $C_2F_6$, $C_3F_8$, $C_4F_{10}$, $C_5F_{12}$, $C_6F_{14}$, $C_7F_{16}$, and $C_8F_{18}$; HCFC materials HCFC-22 ($CHClF_2$), HCFC-122 ($C_2HF_2Cl_3$) , HCFC-123 ($C_2F_3HCl_2$), HCFC-124 ($C_2F_4ClH$), and NAFS-3; HFC materials HFC-125 ($C_2F_5H$), HFC-227ea ($C_3F_7H$) and HFC-23 ($CHF_3$); and HBFC material HBFC-22B1 ($CHF_2Br$).

Foaming chamber area FC creates by mechanical means a suitable fire fighting foam due to the agitation caused by the turbulence of the fluids entering and circulating within foaming chamber FC. In the embodiment of FIG. 1 the foam produced in foaming chamber area FC is delivered through discharge tube DT to the fire.

It is recognized by those of skill in the art that the absolute boundaries of the chamber area in which the foam is formed in mechanical foam making assembly FA are difficult to determine and define with exactness. The chamber area is not completely defined by the structural walls of the assembly and it is probable that in most usages foam will continue to be formed to some extent after discharge, either in a discharge tube DT or in the air. Such continued foaming is desirable and enhances the effectiveness of a foam making assembly FA. Thus, reference to foaming chamber area FC refers to the chamber area where the mechanical foam is primarily or predominantly produced. It does not intend to imply that no further foam may be produced downstream during the discharge process.

If inert gas is supplied to foaming chamber FC in liquid form, then allowance will be made for its expansion factor as the liquid gas turns into the gaseous state.

Figure 2:
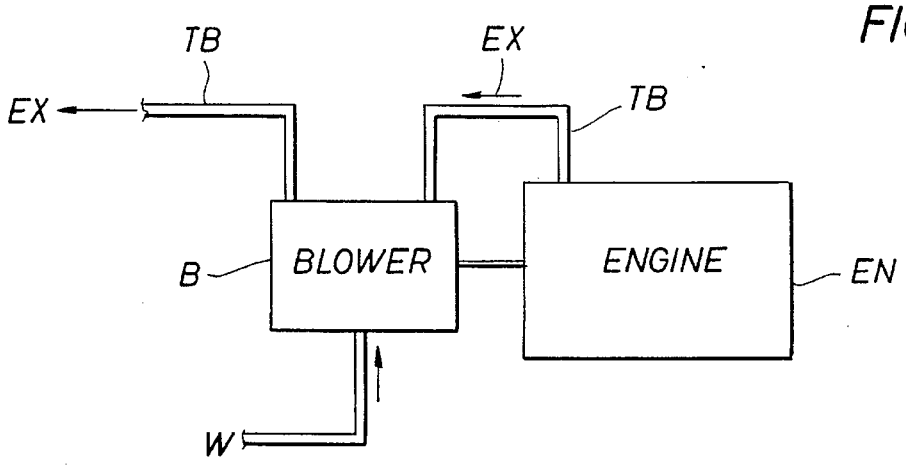
FIG. 2 illustrates schematically an engine source of exhaust gas.

FIG. 2 illustrates schematically how exhaust EX from engine EN, utilized as a source of supply of inert gas, might be delivered or piped to a foam making assembly FA. In particular, FIG. 2 illustrates the insertion of blower B in the delivery line comprised of tubing TB. Blower B is powered by engine EN and serves to propel or pressure exhaust EX toward foam making assembly FA. FIG. 2 also illustrates the use of water W to cool blower B if such appears necessary in light of the temperatures experienced.

FIG. 3 illustrates in more detail a more specific embodiment of the present invention. FIG. 3 illustrates a mechanical foam making assembly FA that is shown, as in FIG. 1, discharging foam through discharge tube DT. In the embodiment of FIG. 3 liquid, or water, enters foam making assembly FA from the left. This liquid precedes partially through eductor E and partially around eductor E in the bore of the assembly. Foam concentrate C is educted into and through eductor E wherein it mixes with a portion of the liquid entering eductor E and exits into foaming chamber area FC. Further portions of liquid L, typically water, also enter foaming chamber FC from around eductor E. A fitting FT is provided for the assembly encircling gas ports GP on the sides of chamber FC. Fitting FT contains a gas inlet GI for the introduction of gas G. In the embodiment of FIG. 3 gas G could comprise any inert gas, such as the exhaust from engine EN, piped to fitting FT through tubing TB.

Inert mechanical foam F produced in chamber FC through the agitation caused by the turbulence of the fluids passing through the chamber exits foaming chamber area FC through discharge tube DT. Discharge tube DT contains throat T providing a portion of discharge tube DT with a passageway of reduced diameter. The throat portion of the discharge tube opens into a further portion WP of the discharge tube that comprises a passage of wider diameter than the throat. Throat T serves to provide back pressure to chamber FC and speed the velocity of foam F.

FIG. 4 illustrates an embodiment of the present invention in an aspirating nozzle with an annular orifice. Foam concentrate and liquid solution L+C, the liquid usually comprising water, enters the nozzle through opening 21 in the bore, to the left in the drawing. Inert gas G, such as an exhaust from engine EN or bottled $CO_2$ or a specialized fire extinguishing gas, as denominated above, enters the nozzle through inlet 22. The annular orifice 23 increases the liquid and foam concentrate velocity as it moves through the nozzle. Tapered cylinder 24 helps to ensure gas aspiration. The straight portion 25 of the discharge cylinder is utilized to increase the velocity and range of the discharge. Inert mechanical foam F discharges from orifice 26 of nozzle N.

Figure 5:
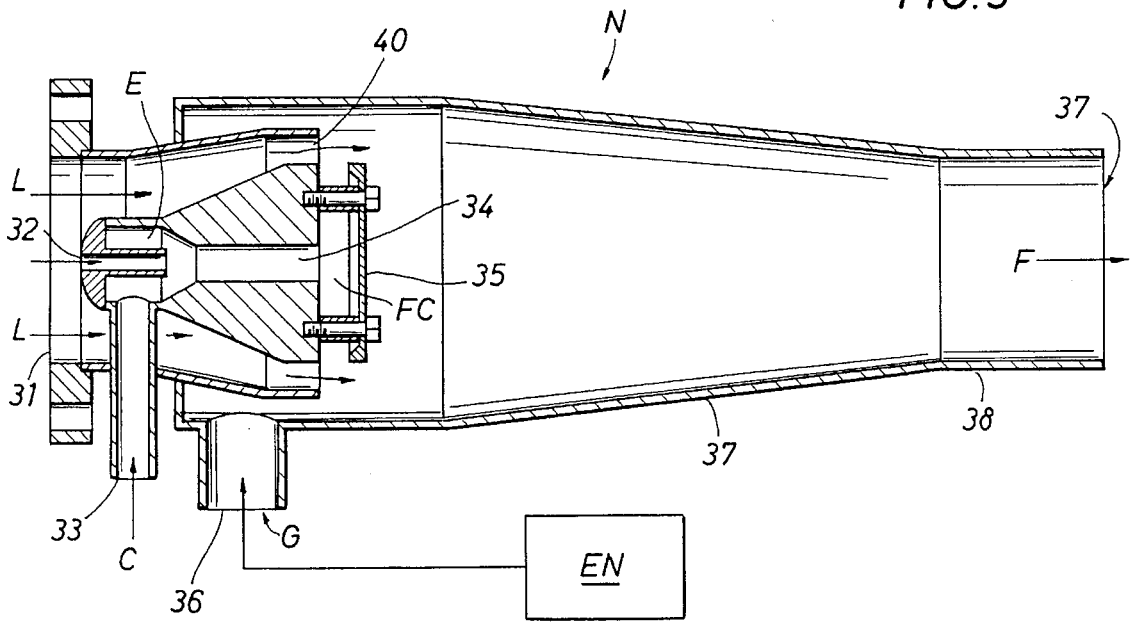
FIG. 5 illustrates in schematic cross-section an embodiment of the invention including an aspirating nozzle, self-educting, with an annular orifice and adapted for an inert gas inlet.

FIG. 5 illustrates an embodiment of the present invention in a self-educting aspirating nozzle with an annular orifice which is fitted for an inert gas intake, such as $CO_2$, engine exhaust or a specialized fire extinguishing gas. Liquid L enters the nozzle of FIG. 5 through inlet 31. Liquid L is typically water. A portion of liquid L enters the inlet 32 for eductor E of nozzle N. Foam concentrate C enters inlet 33 of eductor E, mixes with the liquid entering the eductor and exits the eductor through the channel 34 into foaming chamber FC. The liquid and foam concentrate exiting eductor E through channel 34 impinge upon foam flood plate 35, thereby increasing the agitation and turbulence of the liquid and foam concentrate fluids within foaming chamber area FC. Foaming chamber area FC is indicated as overlapping flood plate 35 in the embodiment of FIG. 5. In this circumstance foaming takes place on both sides of flood plate 35 and/or around the plate's annular edges. Further liquid L enters foaming chamber area FC through annular passage 40 around eductor E. Annular passage 40 increases the liquid velocity as the liquid enters foaming chamber area FC. Gas inlet 36 provides an inlet for gas G. In the present invention gas G will comprise an inert gas. Again, inert gas G might comprise the exhaust from engine EN, or $CO_2$ from a bottled source, or a specialized fire extinguishing gas. Inert gas G mixes with the liquid and foam concentrate in foaming chamber FC to create an inert mechanical foam F that exits the nozzle through discharge orifice 39. A tapered cylinder portion 37 is provided to enhance gas aspiration. Straight cylinder portion 38 is provided to increase the velocity and range of discharged foam F.

Figure 6:
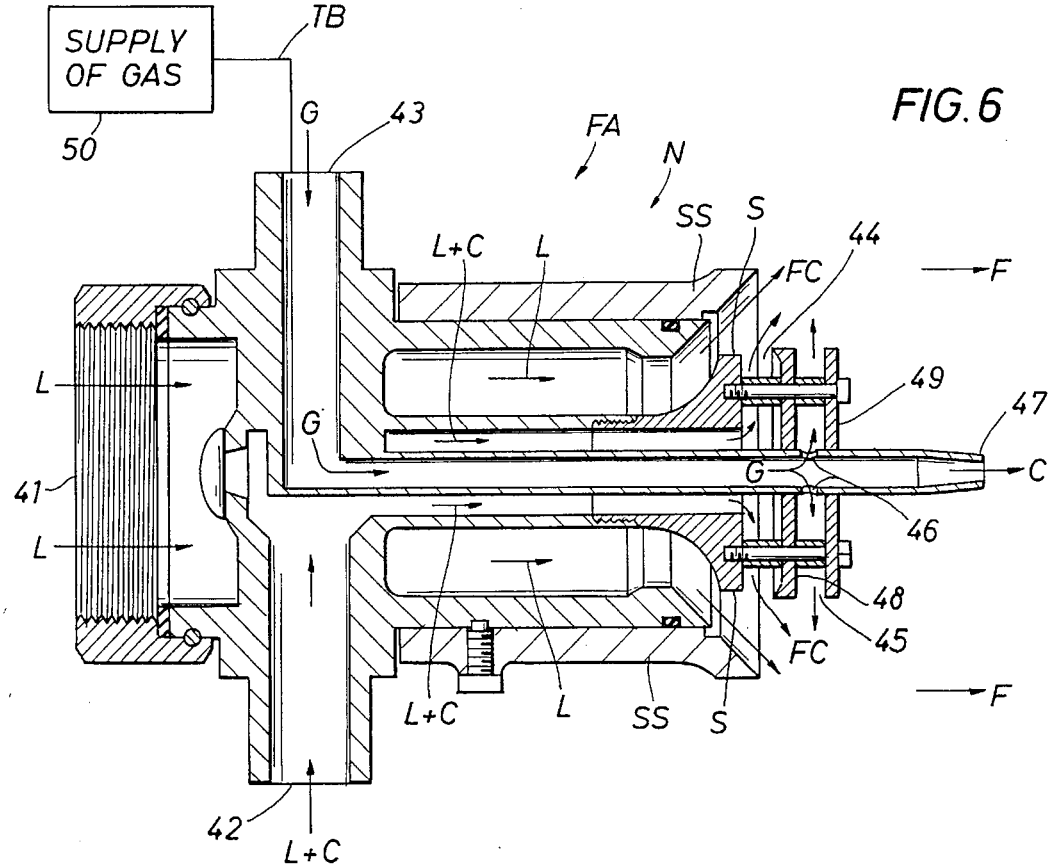
FIG. 6 illustrates in schematic cross-section an embodiment of the invention in a nozzle previously adapted to discharge, in addition to foam, a high velocity gas.
Figure 7:
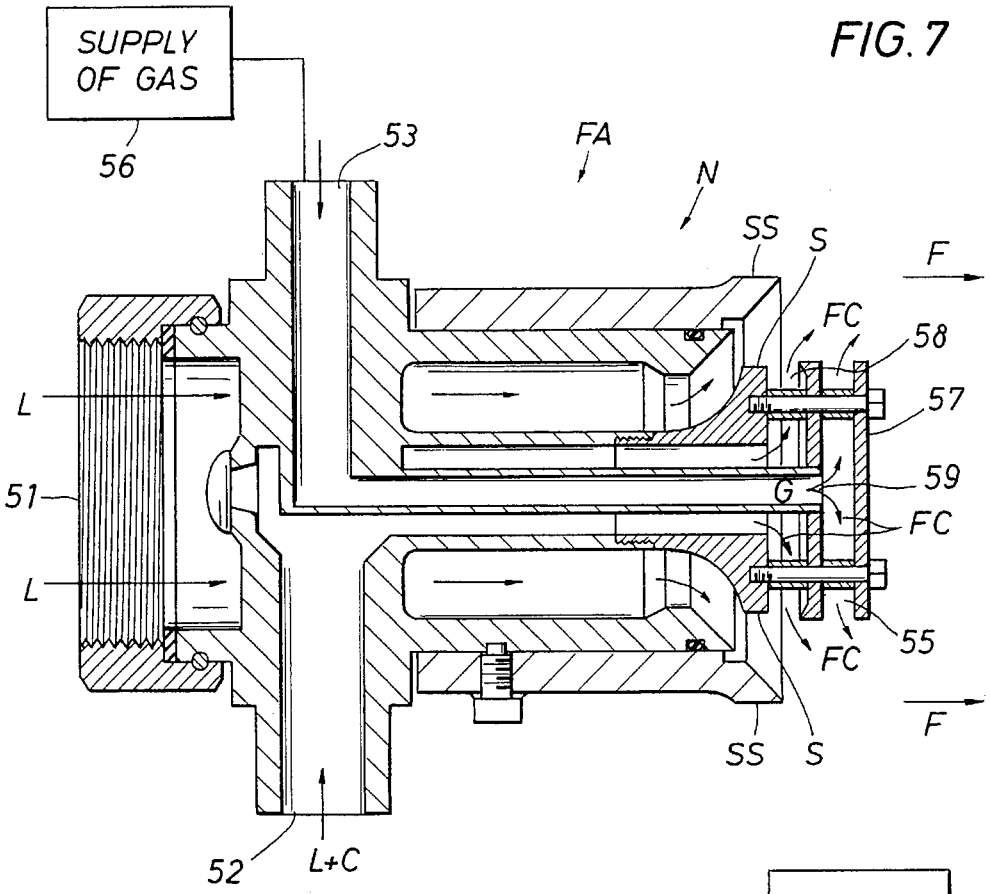
FIG. 7 illustrates in schematic cross-section an alternate version of the embodiment of FIG. 6.

FIGS. 6 and 7 illustrate two versions of a combination foam and high velocity inert gas nozzle adapted for the present invention. In FIG. 6 nozzle N, or foam making assembly FA, retains the capacity for high velocity inert gas discharge through orifice 47. The nozzle has been adapted, however, with inert gas discharge ports 46 in order to produce an inert mechanical foam in accordance with the teachings of the present invention. In the nozzle of FIG. 6 liquid, which is typically water, enters the nozzle through inlet 41 on the left. Concentrate C, or preferably concentrate C diluted with a certain amount of liquid L, is pumped into the nozzle through inlet 42. Gas is supplied to the nozzle through inlet 43 by communicating tubing TB with a supply of gas 50. Gas G is an inert gas which might comprise a specialized fire extinguishing gas, as denominated above, $CO_2$ or the exhaust from an engine. The foaming area FC in the present embodiment is somewhat complex to define. Generally the foaming area in the embodiment of FIG. 6 extends between the end of stem S and first flood plate 48 as well as between first flood plate 48 and second flood plate 49, and also includes the area surrounding the annular edges of stem S and the first and second flood plates. In operation liquid entering the nozzle through liquid inlet 41 is received into the foaming area FC through the annular opening defined between stem S and sleeve SS. Foam concentrate C, preferably diluted with a small portion of liquid L, exits the end of stem S and enters foaming area FC between the end of stem S and the first flood plate 48. This liquid plus concentrate will pass to the annular region around the edges of stem S and the first and second flood plate. Gas from gas supply 50 passes in inlet 43. A portion of such gas exits gas ports 46 between first flood plate 48 and second flood plate 49. This gas also exits between the two flood plates into the annular region surrounding the edges of the flood plates. If sleeve SS is telescoped to the right, in a manner known in the art, the foaming area existing around the annular edges of the stem and flood plates is more clearly defined. However, even with sleeve SS in its retracted position, the region between the stem and the flood plates and the area around the annular edges of the stem and flood plates define a foaming area in which the liquid, the foam concentrate and the gas mix through the agitation and turbulence of the moving fluids to form inert mechanical foam bubbles which are discharged as foam F to the right. The embodiment also indicates that a high velocity gas discharge G may be discharged from the nozzle, encompassed by the discharge of inert foam F.

FIG. 7 offers an alternative embodiment of the nozzle or foaming assembly FA of FIG. 6. In the embodiment of FIG. 7 the capacity for a high velocity gas discharge encompassed within the foam discharge is eliminated. In the embodiment of FIG. 7 all of the gas supplied by supply 56 and entering inlet 53 exits outlet 59 into the foaming area defined between the first flood plate 58 and the second flood plate 57. As in the embodiment of FIG. 6, this gas G is aerated with the liquid and liquid L and foam concentrate C arriving in foaming area FC via the space between the end of stem S and first flood plate 58 as well as the annular passageway defined between the end of stem S and sleeve SS. Mechanical inert foam F is discharged by the embodiment of FIG. 7 to the right, the shape of the discharged stream being determined to a certain extent by whether sleeve SS is telescoped forward or remains in its retracted position, as illustrated in FIG. 7.

Figure 8A:
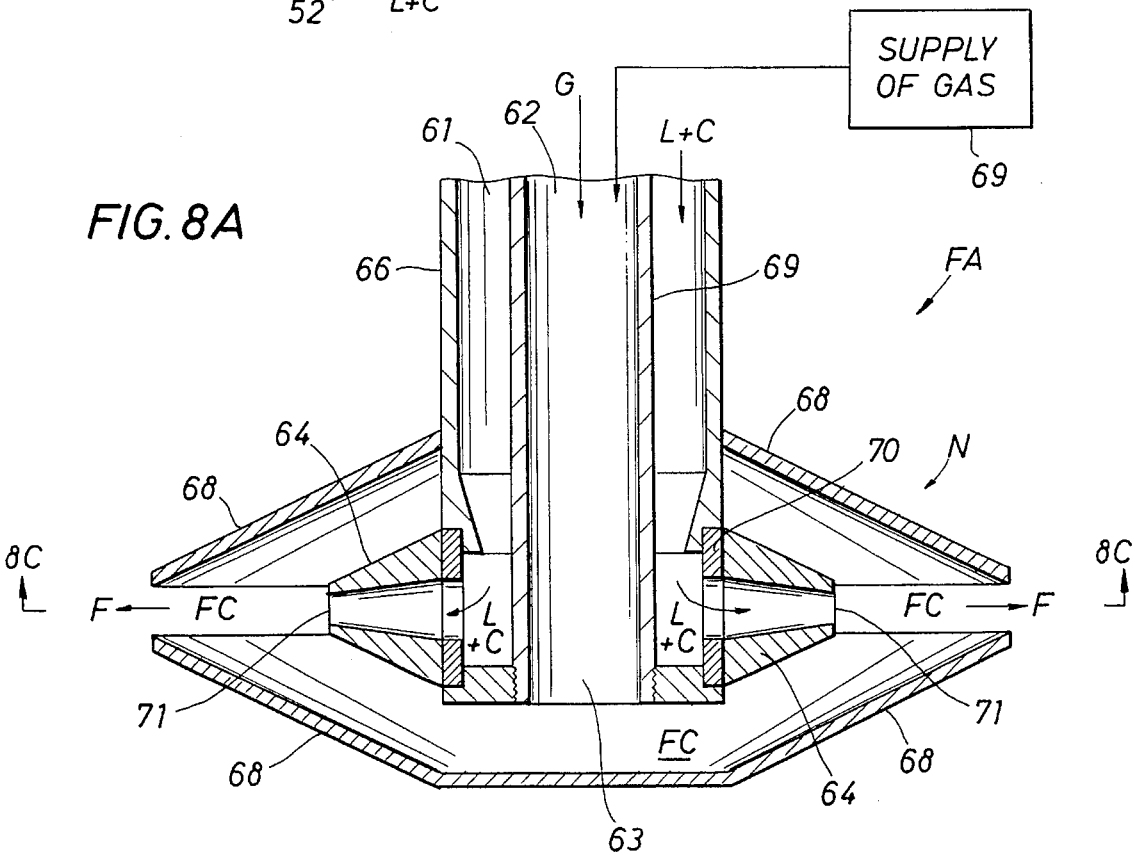
FIG. 8A illustrates in schematic cross-section an embodiment of the invention in a rotating nozzle.
Figure 8B:
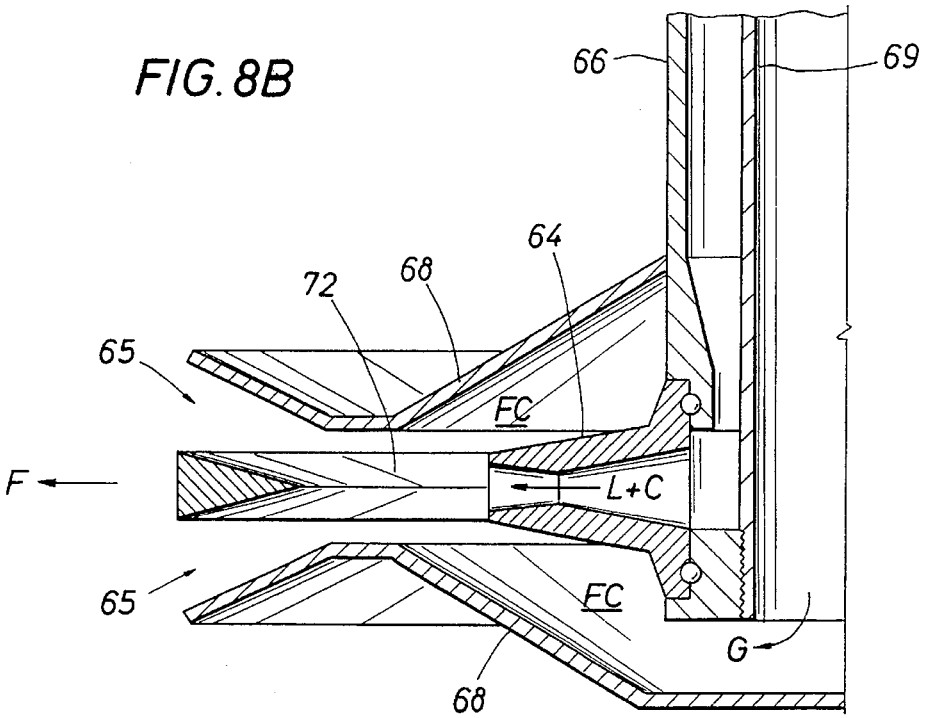
FIGS. 8B and 8C illustrate further details of the embodiment of FIG. 8A.
Figure 8C:
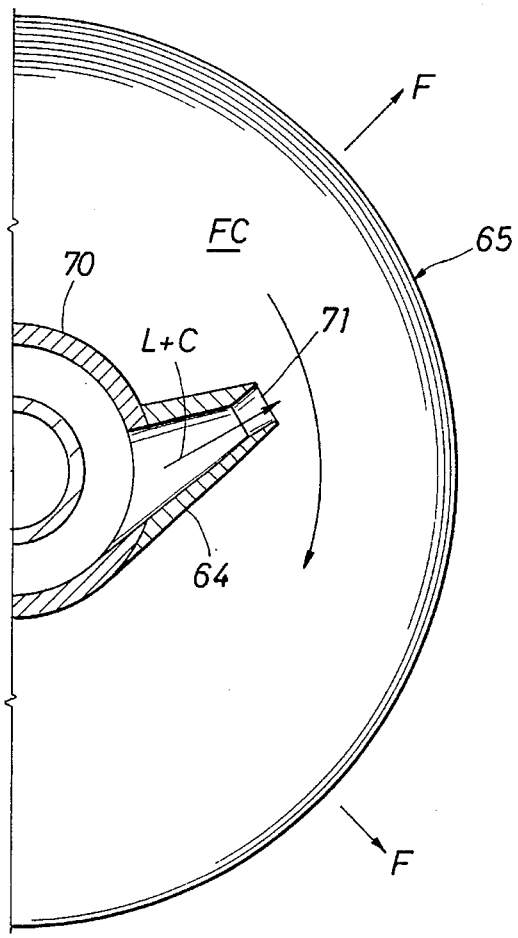

FIG. 8A illustrates a rotating nozzle adapted for the present invention. In the embodiment of FIG. 8A a liquid L plus foam concentrate C enter an annular passageway 61 defined by tube or wand 66 and interior tube 69. Inert gas from inert gas supply 69 enters or passes through passageway 62 defined by tube 69 within wand or tube 66. Gas G enters foaming chamber area FC through outlet 63. The liquid and foam concentrate enter foaming chamber area FC through outlet 71 of spinning subnozzles 64. Spinning subnozzles 64 are connected to annular piece 70 which is adapted to rotate freely in a channel defined in the base of wand or tube 66. FIG. 8C offers a cutaway top view of portions of the embodiment of FIG. 8A. From Figure 8C it can be seen that spinning subnozzle 64 has its axis at an angle with the axis of rotation of annular piece 70. Thus, the discharge of liquid L and foam concentrate C from orifice 71 will serve to rotate band 70 and subnozzle 64 in a clockwise direction, as depicted in FIG. 8C. The rotation of subnozzle 64 within foaming chamber area FC defined by walls 68, indicated schematically in FIG. 8A, creates agitation and turbulence to generate suitable foam bubbles for fire extinguishing purposes. Inert mechanical foam F generated in foaming chamber area FC exits the nozzle of the embodiment of FIG. 8A through annular discharge opening 65. FIG. 8B illustrates an alternative embodiment for the embodiment of FIG. 8A in which the walls forming exterior portions of nozzle N define an enlarged foam discharge opening 65. In the embodiment of FIG. 8A multiple spinning subnozzles 64 would typically be employed. In FIG. 8B structural element 72 might divide discharge opening 65 into a lower and an upper discharge opening.

The foregoing disclosure and description of the invention are illustrative and explanatory thereof. Various changes in the size, shape and materials as well as the details of the illustrated construction may be made without departing from the spirit of the invention.

We claim:

1. A fire fighting system comprising:

a nozzle having a discharge orifice;

means for discharging liquid from said orifice;

a source of inert gas;

means for communicating said inert gas from said source of inert gas to a foaming area at said discharge orifice;

a source of foam concentrate;

means for communicating said foam concentrate from said source of foam concentrate to said foaming area; and means for mixing said inert gas and said foam concentrate with said liquid in said foaming area at said discharge orifice to thereby form mechanical foam.

2. The fire fighting system of claim 1, further comprising a pair of flood plates located in said foaming area, and wherein at least a portion of said inert gas is communicated to said foaming area between said flood plates.

3. The fire fighting system of claim 1, further comprising a flood plate located in said foaming area, and wherein at least a portion of said inert gas is communicated to said foaming area downstream of said flood plate.

4. The fire fighting system of claim 1, wherein said source of inert gas comprises an engine exhaust.

5. The fire fighting system of claim 1, wherein said means for communicating said inert gas from said source of inert gas to said foaming area includes a blower.

6. The fire fighting system of claim 1, wherein said source of inert gas comprises shipboard flue gasses.

7. The fire fighting system of claim 1, wherein said source of inert gas comprises a bottled liquid gas.

8. A method of fighting fire comprising:

providing a nozzle having a discharge orifice;

discharging liquid from said orifice;

providing a source of inert gas;

communicating said inert gas from said source of inert gas to a foaming area at said discharge orifice;

providing a source of foam concentrate;

communicating said foam concentrate from said source of foam concentrate to said foaming area;

mixing said inert gas and said foam concentrate with said liquid in said foaming area at said discharge orifice to thereby form mechanical foam; and projecting said mechanical foam through the air to said fire.

* * * * *